US012297014B2

(12) United States Patent
Tong et al.

(10) Patent No.: US 12,297,014 B2
(45) Date of Patent: May 13, 2025

(54) COVER AND MANUFACTURING METHOD THEREFOR

(71) Applicant: BE GREEN PACKAGING CO., LTD., Jiangsu (CN)

(72) Inventors: Ji Tong, Jiangsu (CN); Jinmeng Li, Jiangsu (CN); Zhijia Liu, Jiangsu (CN)

(73) Assignee: BE GREEN PACKAGING CO., LTD., Jiangsu (CN)

( * ) Notice: Subject to any disclaimer, the term of this patent is extended or adjusted under 35 U.S.C. 154(b) by 431 days.

(21) Appl. No.: 17/762,540

(22) PCT Filed: Sep. 25, 2020

(86) PCT No.: PCT/CN2020/117808
§ 371 (c)(1),
(2) Date: Mar. 22, 2022

(87) PCT Pub. No.: WO2021/057912
PCT Pub. Date: Apr. 1, 2021

(65) Prior Publication Data

US 2022/0380095 A1 Dec. 1, 2022

(30) Foreign Application Priority Data

Sep. 25, 2019 (CN) ..... 201910908920.6
Sep. 25, 2019 (CN) ..... 201921601004.X

(51) Int. Cl.
*B65D 47/14* (2006.01)
*A47G 19/22* (2006.01)
*D21J 1/04* (2006.01)

(52) U.S. Cl.
CPC ..... *B65D 47/141* (2013.01); *A47G 19/2272* (2013.01); *D21J 1/04* (2013.01)

(58) Field of Classification Search
CPC ..... D21J 1/04; D21J 3/00; D21J 7/00; B65D 2543/00074; B65D 2543/00527;
(Continued)

(56) References Cited

U.S. PATENT DOCUMENTS 7,131,551 B2 11/2006 Smith
7,954,659 B2 * 6/2011 Zuares ..... B65D 47/0804 220/374
(Continued)

FOREIGN PATENT DOCUMENTS

CN 1105644 U 7/1995
CN 1038025 C 4/1998
(Continued)

OTHER PUBLICATIONS (PCT) China National Intellectual Property Administration (ISA/CN), International Search Report (with partial English translation), International Application No. PCT/CN2020/117808, 9 pages, Dec. 31, 2020.
(Continued)

*Primary Examiner* — Kareen K Thomas
(74) *Attorney, Agent, or Firm* — Benesch Friedlander Coplan & Aronoff LLP

(57) ABSTRACT

A cover (200) and a manufacturing method therefor. The cover (200) comprises a dispensing port (212), a detachable plug (250) that is located at the peripheral edge (230) of the cover (200) and integrally formed with the cover (200), and a recess (222). When a sealing structure is formed between the cover (200) and a cup (100), the dispensing port (212) is used for providing an outlet for contents present in the cup (100). The detachable plug (250) comprises a protrusion (255), and the protrusion (255) is used to form another sealing structure between the protrusion (255) and the dispensing port (212). The recess (222) is configured to be
(Continued)

detachably coupled with the protrusion (255) so as to keep the detachable plug (250) in the vicinity of the cover (200) when the detachable plug (250) is not in use.

8 Claims, 13 Drawing Sheets

(58) Field of Classification Search
CPC ..... B65D 2543/00629; B65D 2543/00685; B65D 43/0212; B65D 2543/00046; B65D 2543/00305; B65D 2543/00537; B65D 2543/00731; B65D 2543/00796; B65D 17/507; B65D 65/466; B65D 47/06; B65D 47/14; B65D 51/18; B65D 55/16; B65D 85/72; A47G 19/22; A47G 2400/10
See application file for complete search history.

(56) References Cited

U.S. PATENT DOCUMENTS

| | | | | |
|---|---|---|---|---|
| 8,276,776 | B2 * | 10/2012 | Roth | B65D 81/3876 220/254.1 |
| 8,851,325 | B1 | 10/2014 | Chiang | |
| 9,908,667 | B1 * | 3/2018 | Smith | B65D 43/16 |
| 2016/0198876 | A1 * | 7/2016 | Mithal | B65D 43/0208 220/719 |
| 2018/0086511 | A1 | 3/2018 | Lin | |

FOREIGN PATENT DOCUMENTS

| | | | |
|---|---|---|---|
| CN | 1647948 | A | 8/2005 |
| CN | 203667191 | U | 6/2014 |
| CN | 209306147 | U | 8/2019 |
| CN | 110742464 | A | 2/2020 |
| CN | 211212466 | U | 8/2020 |
| EP | 2757194 | A2 | 7/2014 |
| KR | 20-1998-0059278 | U | 10/1998 |
| KR | 20-0412075 | U | 3/2006 |

OTHER PUBLICATIONS (PCT) China National Intellectual Property Administration (ISA/CN), Written Opinion of the International Searching Authority (English translation), International Application No. PCT/CN2020/117808, 5 pages, Dec. 31, 2020.
European Search Report in European foreign counterpart application No. EP 20867198, dated Sep. 25, 2023.
English translation of Notice of Preliminary Rejection in Korean counterpart application No. KR 10-2022-7013613, dated Sep. 24, 2024.

* cited by examiner

COVER AND MANUFACTURING METHOD THEREFOR

TECHNICAL FIELD

The present invention relates to a beverage cup cover, specifically a cover, such as a decomposable, recyclable and biodegradable beverage cup cover with a detachable plug and a plug holding part.

BACKGROUND

Beverage cup covers and other "disposable plastic products" are usually made of plastic #6 or plastic #7. Plastic #6 consists of polystyrene. Plastic #6 exudes a known carcinogen and toxin, especially when heated. Therefore, there is a serious problem with coffee cup covers made of plastic #6, because those coffee cup covers will be exposed to the high temperature of hot coffee during intended use. Plastic #7 consists of various plastics (such as plastic resins or combinations of other plastics) and has been found to include the chemical toxins bisphenol A (or BPA) and/or bisphenol S (or BPS). BPA and BPS are endocrine disruptors, which can lead to adverse developmental effects, reproductive effects, neurological effects and immunological effects. Therefore, the beverage cover made of plastic #7 also has problems. In addition to these concerns regarding toxicity, beverage cup covers and other food packaging products made of plastic #6 or plastic #7 also have a significant long-term impact on the environment, because these disposable plastics are not biodegradable and are piled up in landfills. Even if these products are decomposed, it will take hundreds or even thousands of years. At the same time, toxic chemicals seep from these waste materials and affect the surrounding ecosystem by polluting soil and groundwater. Therefore, a decomposable, recyclable and biodegradable disposable beverage cup cover is needed.

In addition to protecting the environment, a convenient beverage cup cover for hot or cold drinking cups is also needed; That is to say, we need such a cover with straw hole, a dispensing port or a "nozzle" which can be can selectively plugged by user using a plug (for example, to prevent or reduce the possibility of fluid overflow and, in the presence of hot fluid, to prevent or reduce the possibility of heat loss), and the plug can be easily retained by the user during the whole process of the user drinking the beverage. Although there are "loose" plugs for such a beverage cup cover, such plugs can easily be misplaced or lost, especially when the user repeatedly removes and replaces the plug during the normal process of drinking the beverage in the cup on which the cover is placed. Therefore, we still need a beverage cup cover that provides an effective and simple method to maintain the plug when the plug is not in use.

SUMMARY OF THE INVENTION

The present invention solves above-mentioned and other problems related to the prior art by providing a cover. The cover comprises a dispensing port, a detachable plug that is located at the peripheral edge of the cover and integrally formed with the cover, and a recess that is integrally formed with the top of the cover. The plug can be separated from the cover along a tear line. The size of the protrusion on the plug is designed to be friction fit in the dispensing port on the cover, so as to plug the dispensing port. The size of the protrusion on the plug is also designed to friction fit in the recess on the top of the cover, so as to retain or accommodate the plug for subsequent use, thus preventing the loss of the plug. The cover can be used to create a sealing structure for a cup for accommodating hot or cold beverages (including coffee, tea or fruit juice). In some embodiments, the cover is a decomposable, recyclable and biodegradable disposable beverage cup cover.

BRIEF DESCRIPTION OF THE DRAWINGS

The drawings included in and forming part of this specification show various embodiments of the present invention and are used to illustrate embodiments of the present invention together with above-mentioned summary of the invention and the detailed description of the embodiments below. Like reference numerals represent similar parts throughout the several views of the drawing

DETAILED DESCRIPTION OF PREFERRED EMBODIMENT

Figure 1:
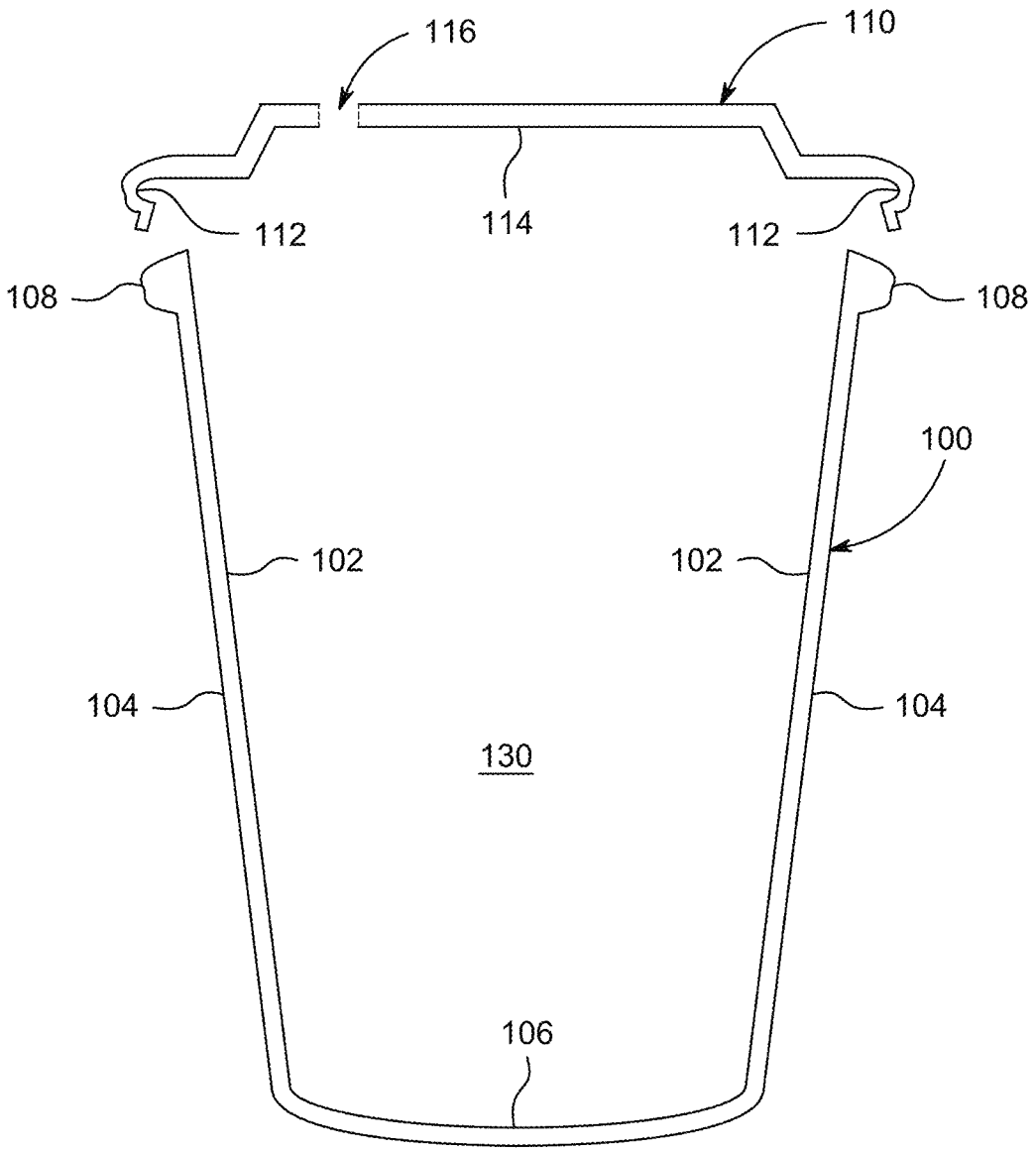
FIG. 1 is the cross-sectional view of a cup and a cover according to an embodiment of the present invention.
Figure 2:
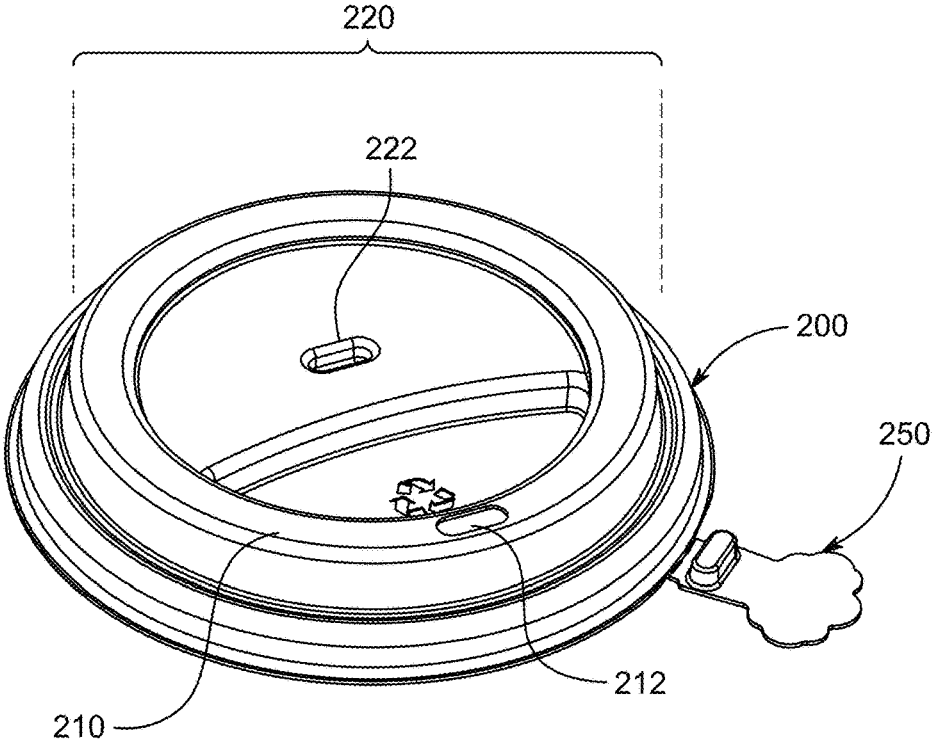
FIG. 2 is a perspective view of a cover having a detachable plug that is located at the peripheral edge of the cover and integrally formed with the cover according to an embodiment of the present invention.
Figure 3:
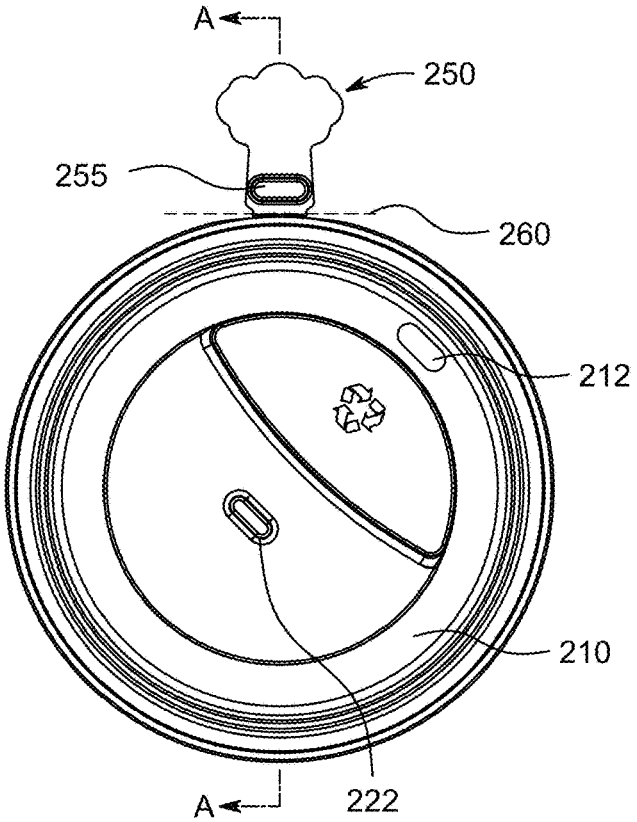
FIG. 3 to FIG. 5 are respectively top, side and front views of the cover of FIG. 2.
Figure 4:
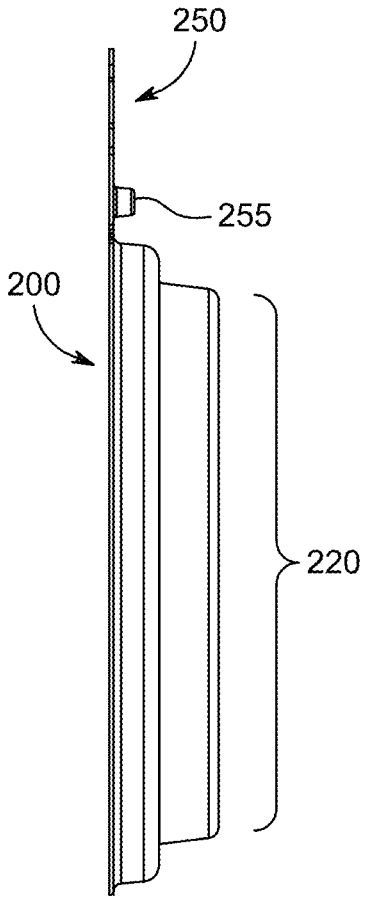
Figure 5:
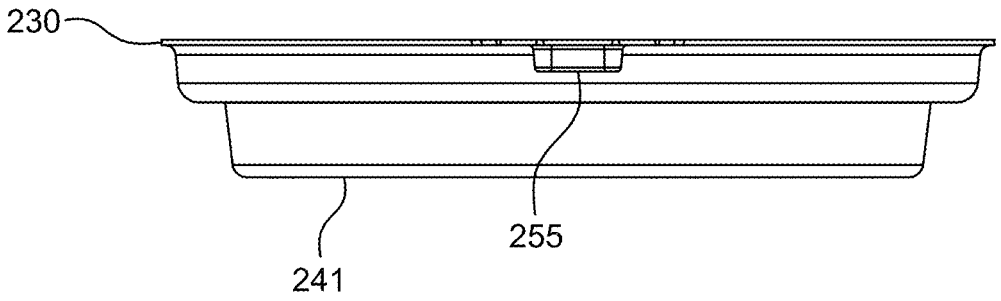
Figure 6:
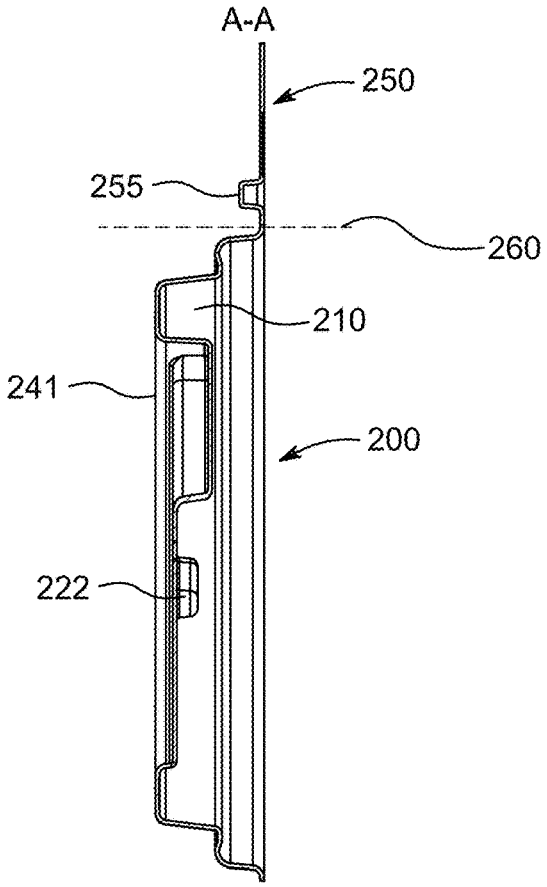
FIG. 6 is a cross-sectional view of the cover of FIG. 2 taken along line A-A of FIG. 3.
Figure 7:
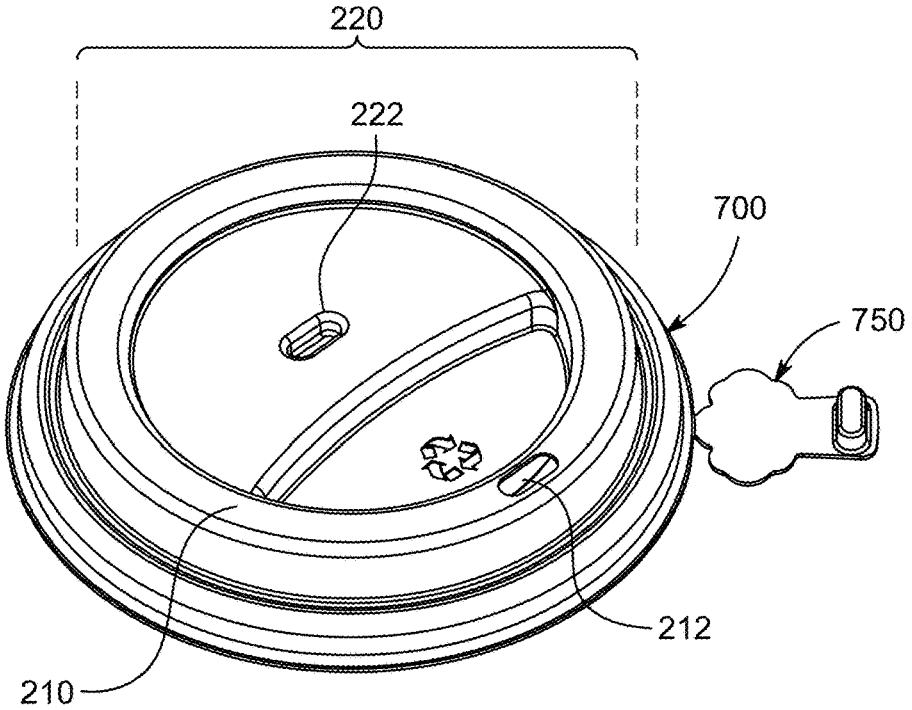
FIG. 7 is a perspective view of another cover having a detachable plug that is located at the peripheral edge of the cover and integrally formed with the cover according to an embodiment of the present invention.
Figure 8:
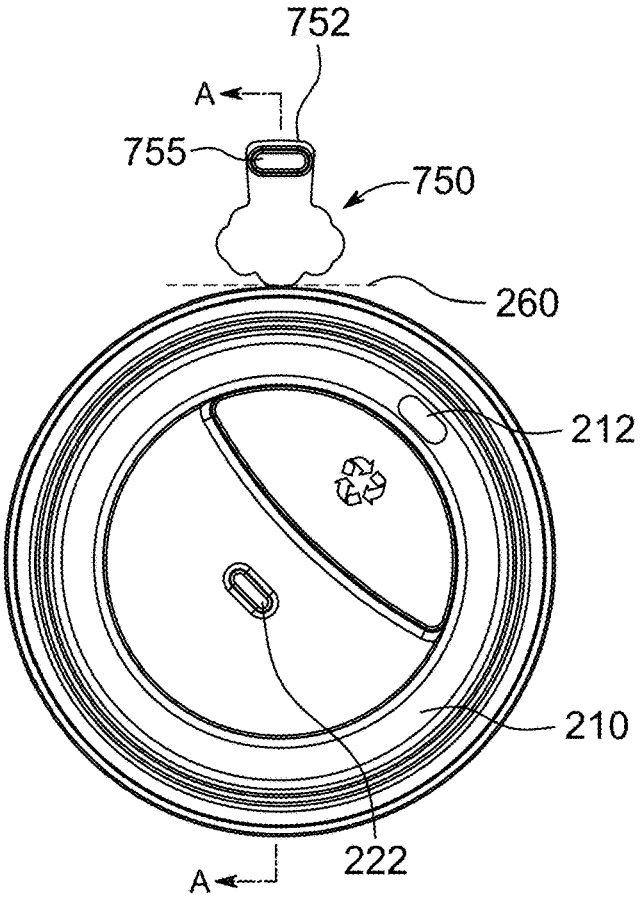
FIG. 8 to FIG. 10 are respectively top, side and front views of the cover of FIG. 7.
Figure 9:
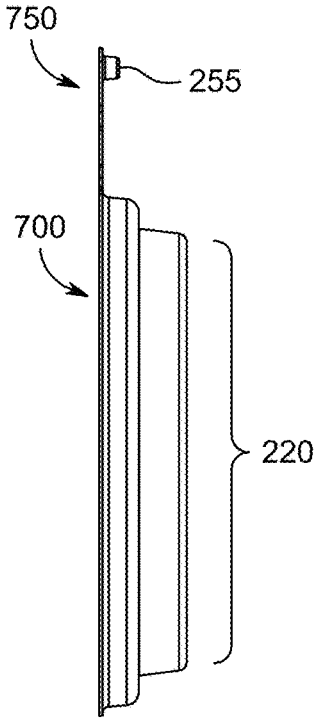
Figure 10:
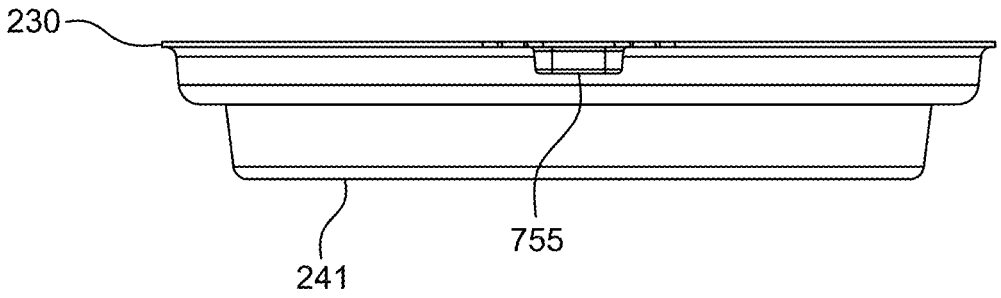
Figure 11:
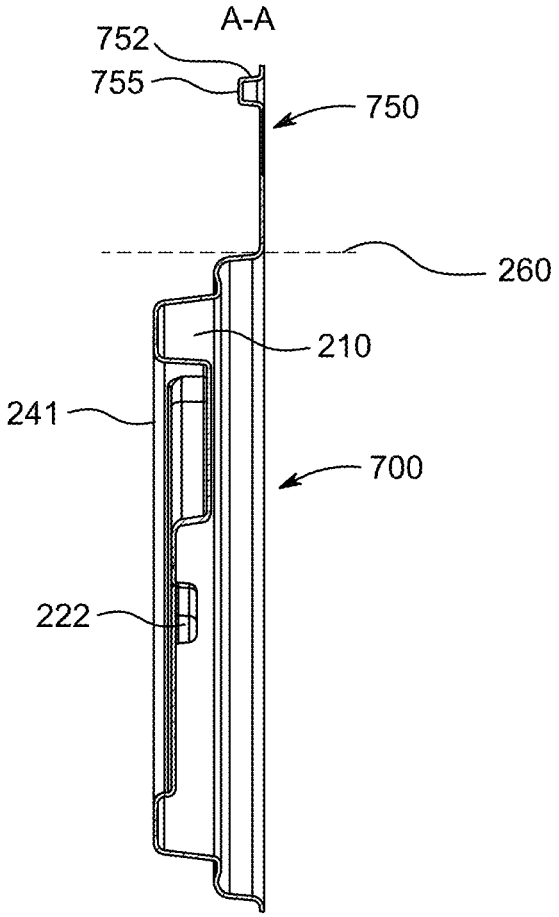
FIG. 11 is a cross-sectional view of the cover of FIG. 7 taken along line A-A of FIG. 8.

For simplicity and illustrative purposes, the principles of the present invention are described by referencing various exemplary embodiments thereof and these embodiments can be described with reference to FIG. 1 to FIG. 24. The present invention is not limited to the specific examples, embodiments and methods described herein or other contents described in the drawings, as these may be varied. Furthermore, the terminology used herein is for the purpose of describing particular embodiments only and is not intended to be limiting of the invention. Although specific methods and materials are described herein, other methods and materials similar to those described herein can be used in the practice of the present invention. Moreover, although certain methods may be described with reference to certain steps that are presented herein in a certain order, in many instances, these steps may be performed in any order as would be appreciated by one of ordinary skill in the art, and thus the methods are not limited to the particular arrangement of steps disclosed herein.

FIG. 1 generally describes an embodiment of a cup 100 and a cover 110 according to the present invention. In FIG. 1, the cup 100 and the cover 110 are shown in an exploded view or a separate view to illustrate their respective features. The cup 100 is a hollow container formed by an upper surface 106 of the cup bottom and a cup wall having an inner surface 102 and an outer surface 104. The opening of the cup 100 is defined along the ridge on the cup wall at the end opposite to the upper surface 106 of the cup bottom. The ridge 108 is adapted to interact with a groove 112 formed in the inner surface 114 of the cover 110 to form a cavity 130 in the cup 100. The interaction between the ridge 108 and the groove 112 forms a sealing structure so that as long as the seal provided by the sealing structure is maintained, the content (such as liquid) provided in the cavity 130 can only leave the cavity 130 through the dispensing port 116.

FIG. 2 to FIG. 6 show an embodiment of the cover 200 having a detachable plug 250 that is located at the peripheral edge 230 of the cover and integrally formed with the cover 250. The cover 200 includes a raised portion 210 surrounding the center portion 220 of the upper surface 241. The raised portion 210 comprises the dispensing port 212 to provide an outlet for the contents of the cup (for example, the cup 100 in FIG. 1) when a sealing structure is formed between the cover 200 and the cup. The cover 200 further comprises a recess 222 formed on the upper surface 241 and located in the center portion 220. The recess 222 is detachably coupled with the protrusion 255 when the detachable plug 250 is separated from the cover 200, so as to keep the detachable plug 250 in the vicinity of the cover 200 (that is, the recess 222 here serves as the holding part of the detachable plug 250). In one embodiment, size of the recess 222 is designed such that the protrusion 255 frictionally fits within the recess 222 when the detachable plug 250 is separated from the cover 200.

The detachable plug 250 may be separated from the cover 200 at the attachment point edge line 260. In one embodiment, the attachment point edge line 26 is specifically a tear line (for example, the tear line 1206 in FIG. 12). The protrusion 255 on the detachable plug 250 is used to interact with the dispensing port 212 when the detachable plug 250 is separated from the cover 200, so as to form another sealing structure between the protrusion 255 and the dispensing port 212. In one embodiment, the size of the protrusion 255 is designed to be friction fit in the dispensing port 212, so as to plug the dispensing port 212. After forming above-mentioned other sealing structure, release of the cup contents can be eliminated as long as the seal provided by the other sealing structure is maintained.

The protrusion 255 protrudes toward one surface of the detachable plug, and a concave groove corresponding to the protrusion is arranged on the other surface of the detachable plug away from the protrusion.

The comparison between the cover 700 and the cover 200 of FIG. 7 to FIG. 11 shows that the detachable plug can be implemented according to various structures in the embodiments of the present invention. For example, the detachable plug 250 of the cover 200 includes a protrusion 255 located on the proximal end near the attachment point edge line 260.

Furthermore, the detachable plug 750 of the cover 700 includes a protrusion 755 located on the distal end 752 opposite to the attachment point edge line 260.

Figure 24:
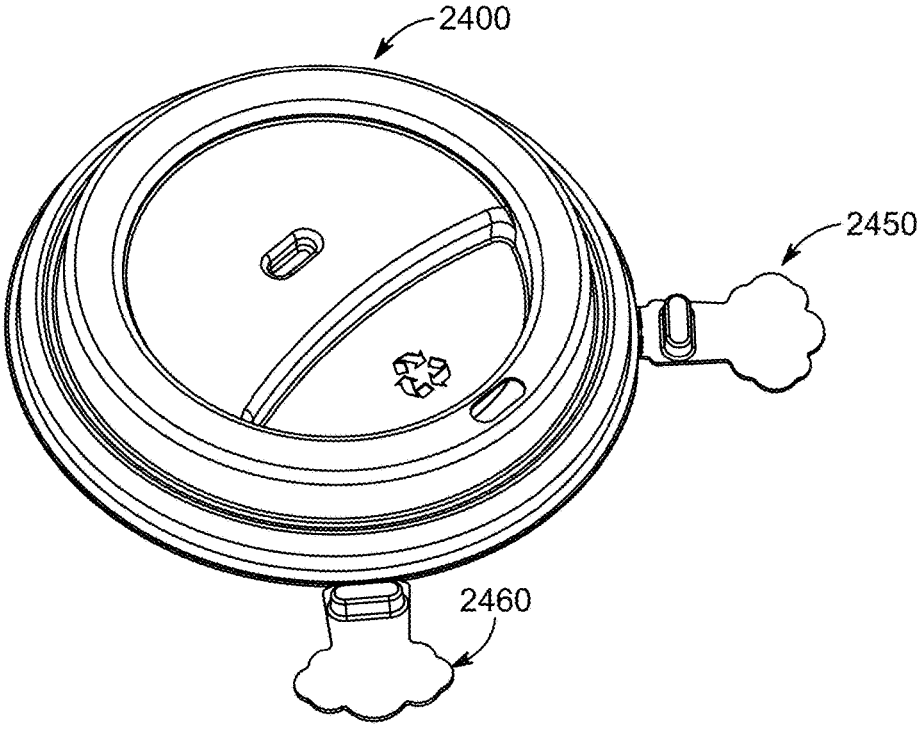
FIG. 24 is a perspective view of another cover having a detachable plug that is located at the peripheral edge of the cover and integrally formed with the cover according to an embodiment of the present invention.

FIG. 24 shows another exemplary structure, wherein a plurality of detachable plugs (i.e., detachable plug 2450 and detachable plug 2460) are integrally formed with the cover 2400. In one embodiment, the plurality of detachable plugs may have protrusions located at different ends. For example, the detachable plug 2450 may have a protrusion at the proximal end, and the detachable plug 2460 may have a protrusion at the distal end. Those skilled in the art will understand that other structures according to embodiments of the present invention are also possible.

Figure 12:
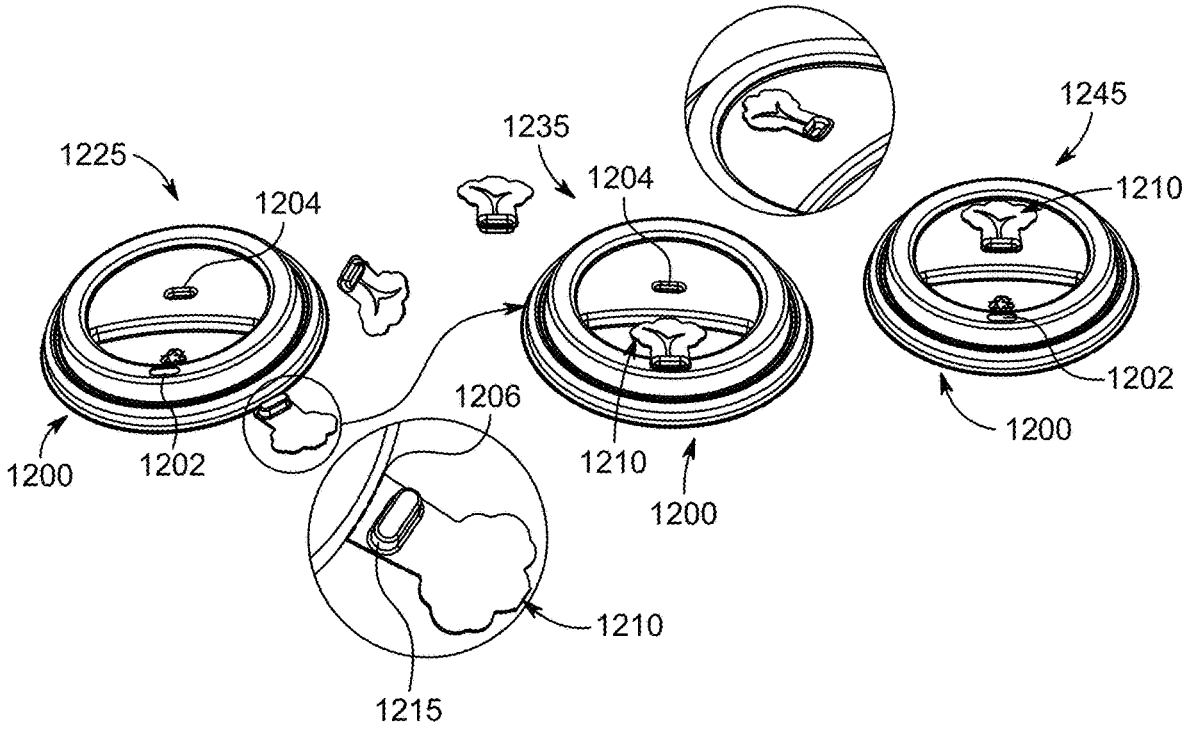
FIG. 12 shows an embodiment of a cover having a detachable plug that is located at the peripheral edge of the cover and integrally formed with the cover in an initial state, plugged state, and holding state.
Figure 13:
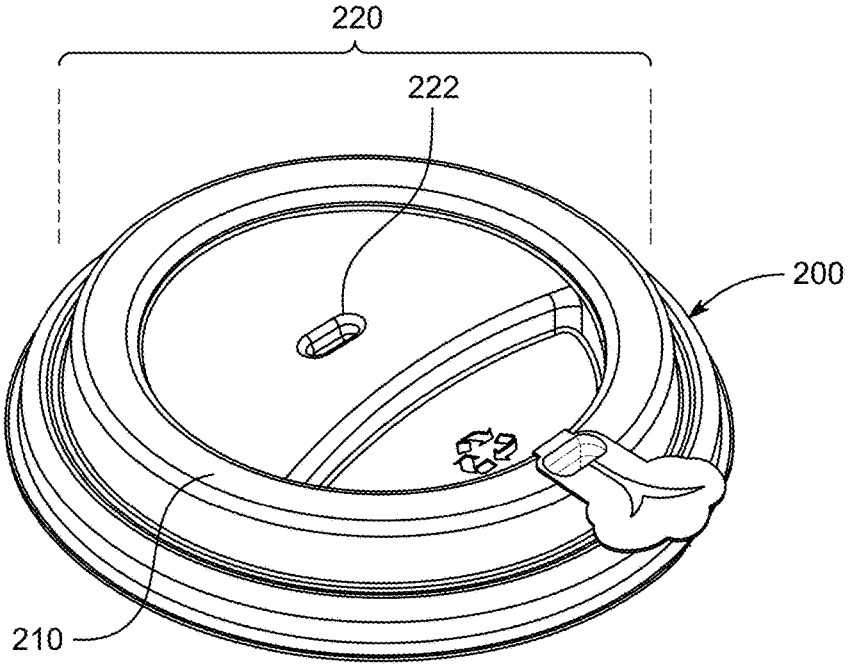
FIG. 13 to FIG. 16 are respectively perspective, top, side and front views of the cover of FIG. 2 in a plugged state.
Figure 14:
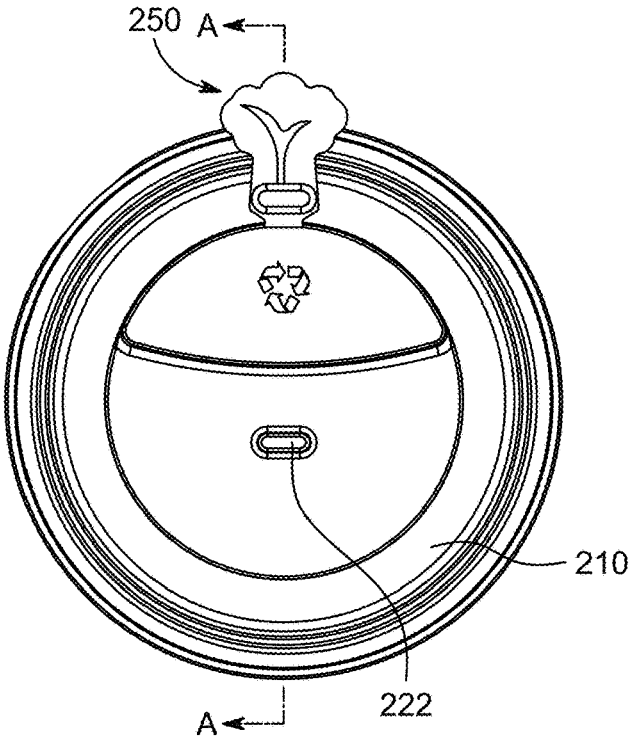
Figure 15:
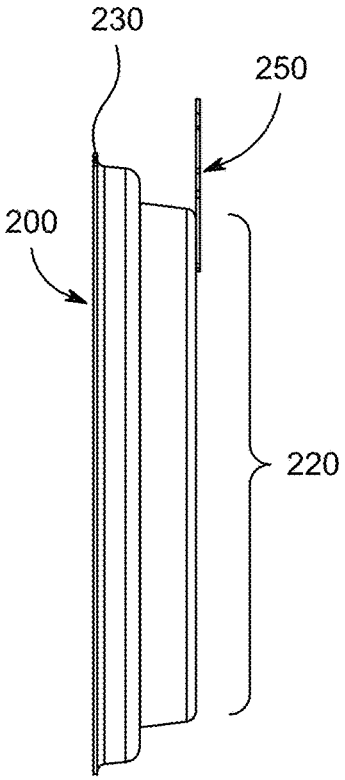
Figure 16:
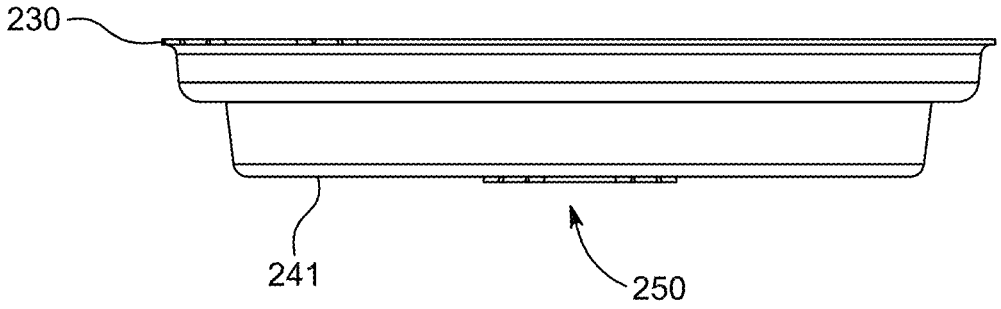
Figure 17:
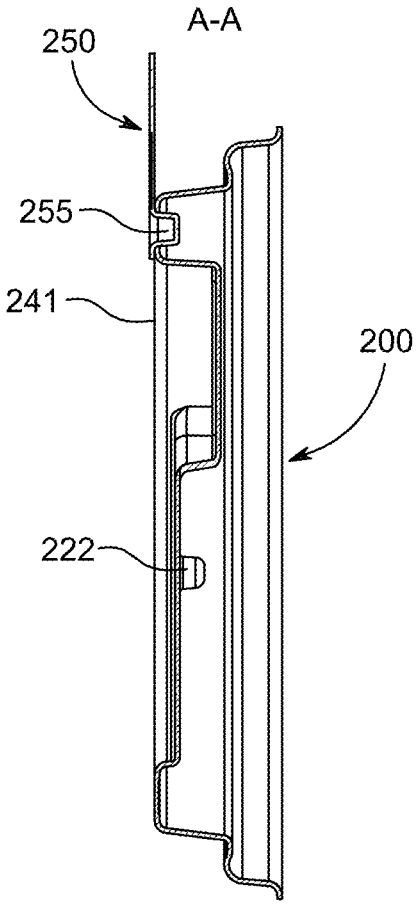
FIG. 17 is a cross-sectional view of the cover of FIG. 2 taken along line A-A of FIG. 3 in a plugged state.
Figure 18:
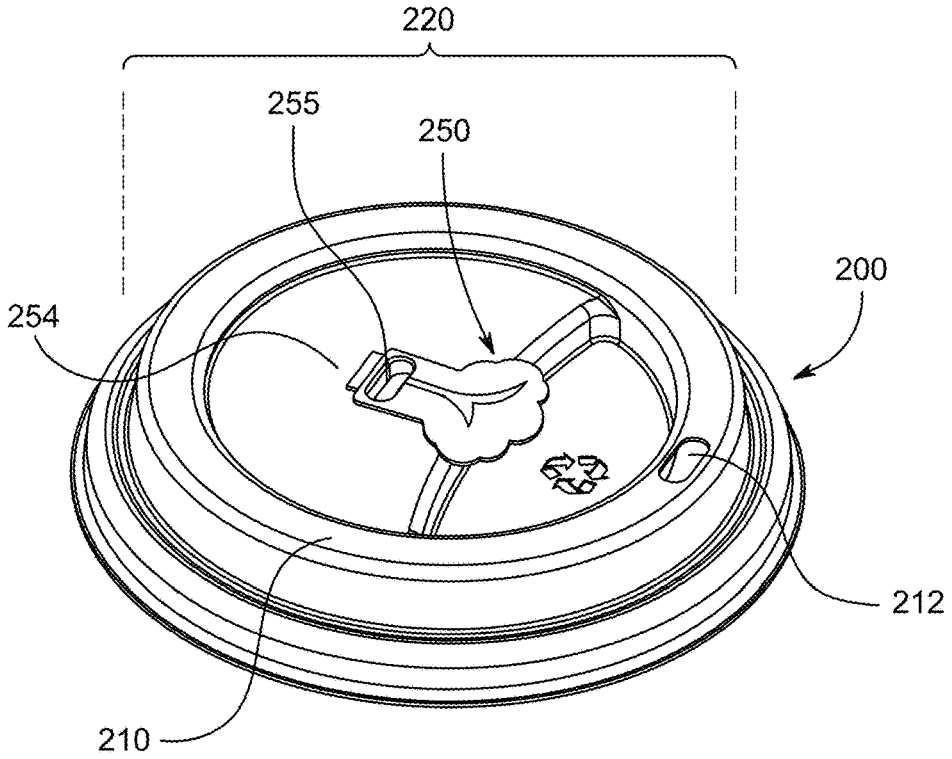
FIG. 18 to FIG. 21 are respectively perspective, top, side and front views of the cover of FIG. 7 in a holding state.
Figure 19:
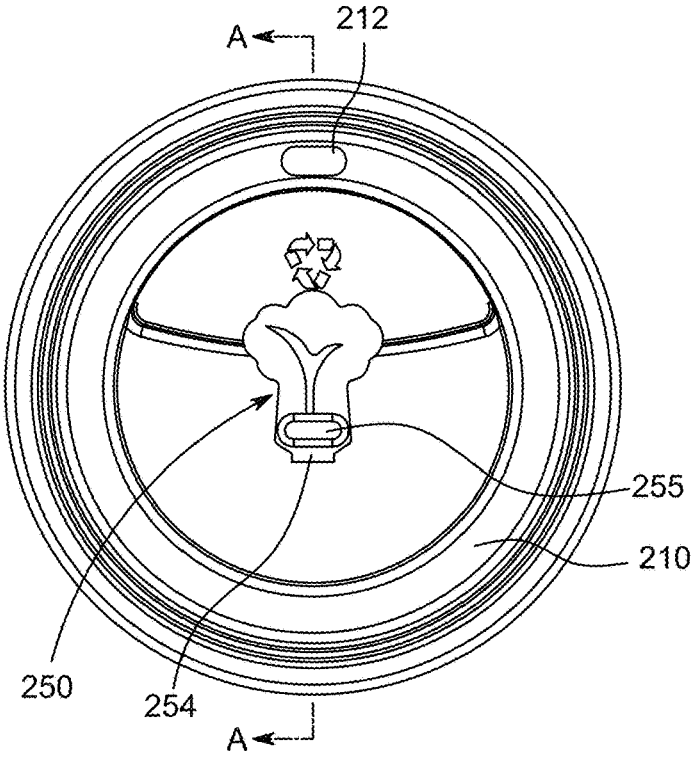
Figure 20:
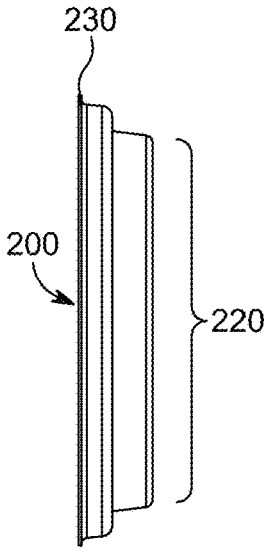
Figure 21:
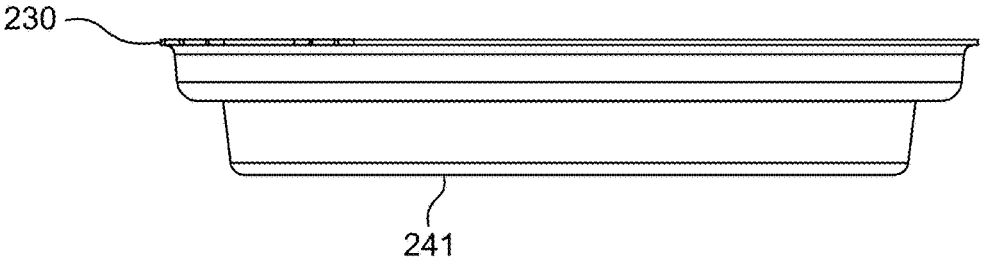
Figure 22:
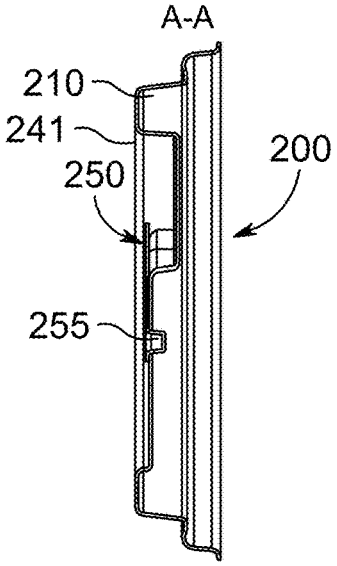
FIG. 22 is a cross-sectional view of the cover of FIG. 7 taken along line A-A of FIG. 8 in a holding state.

FIG. 12 shows that the cover 1200 according to the embodiments of the present invention may be in various states. For example, FIG. 12 shows that the cover 1200 may be in an initial state 1225 in which the detachable plug 1210 remains integrally formed with the cover 1220 at the tear line 1206. When the detachable plug 1210 is separated from the cover 1200, the cover 1200 may be in a plugged state 1235 in which the protrusion 1215 of the detachable plug 1210 is inserted into the dispensing port 1202 of the cover 1200. FIG. 13 to FIG. 17 show the cover 200 of FIG. 2 in the plugged state. When the detachable plug 1210 is separated from the cover 1200, the cover 1200 also may be in the holding state 1245 in which the protrusion 1215 is inserted into the recess 1204 formed on the upper surface of the cover 1200. FIG. 18 to FIG. 22 show the cover 200 of FIG. 2 in the holding state.

Figure 25:
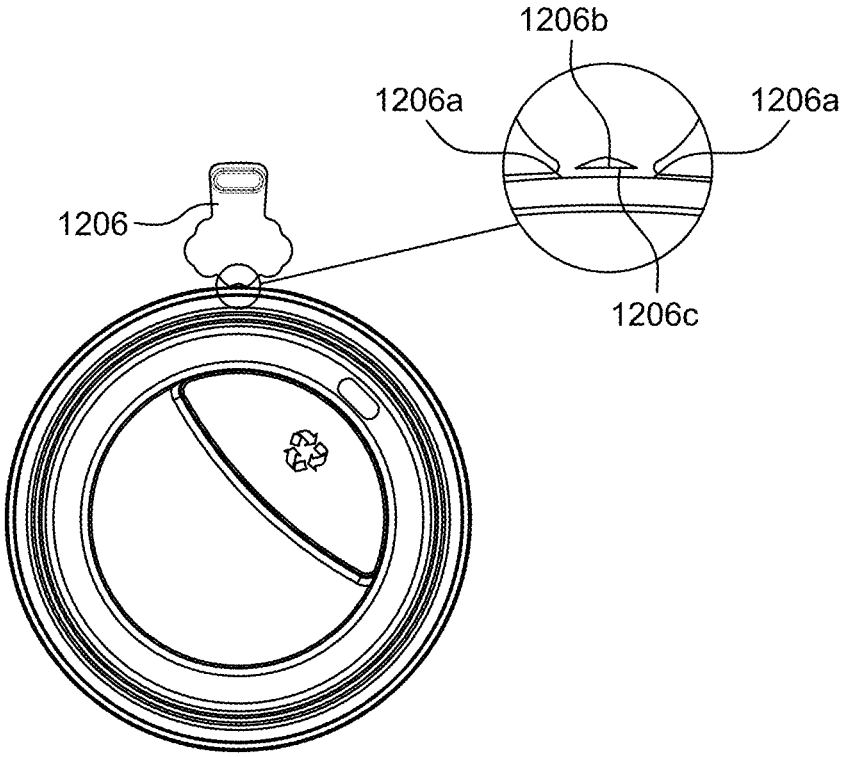
FIG. 25 shows a structural diagram of a first tear line according to an embodiment of the present invention.

FIG. 25 shows a first tear line structure. The tear line includes tear connection points 1206*a* and a concave surface 1206*b*. The tear connection points 1206*a* are connected to both sides of the end of the detachable plug which is close to the cover. The concave surface 1206*b* is located between the two tear connection points and recessed towards the side of the detachable plug away from the cover. The distance from the middle of the concave surface to the peripheral edge of the cover is greater than the distance from both ends of the concave surface to the peripheral edge of the cover. The peripheral edge of the cover is provided with an outer convex part, and the side of the outer convex part away from the peripheral edge of the cover is provided with an arc-shaped convex surface 1206*c*. The distance from the middle of the concave surface to the middle of the arc-shaped convex surface is greater than the distance from both ends of the concave surface to both ends of the arc-shaped convex surface. The concave surface is any one of a V-shaped concave surface and a U-shaped concave surface.

Figure 26:
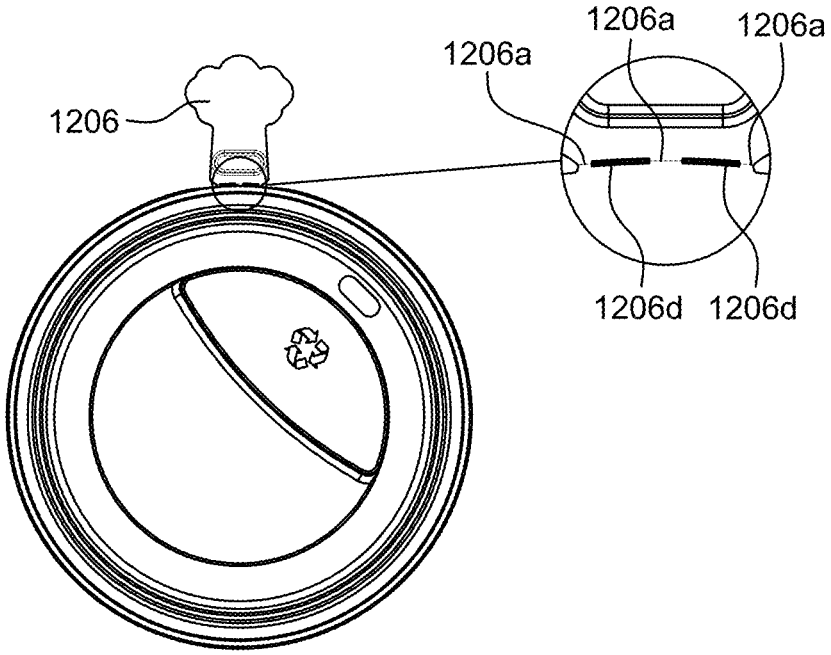
FIG. 26 shows a structural diagram of a second tear line according to an embodiment of the present invention.

FIG. 26 shows a second tear line structure. The tear line includes three tearing connection points 1206*a* arranged at intervals and connected between the end of the detachable plug close to the cover and the peripheral edge of the cover. A strip-shaped tear hole 1206*d* is formed between two adjacent tearing connection points, the peripheral edge of the cover and the end of the detachable plug close to the cover, and the diameter of the strip-shaped tear hole is gradually reduced from top to bottom.

Figure 23:
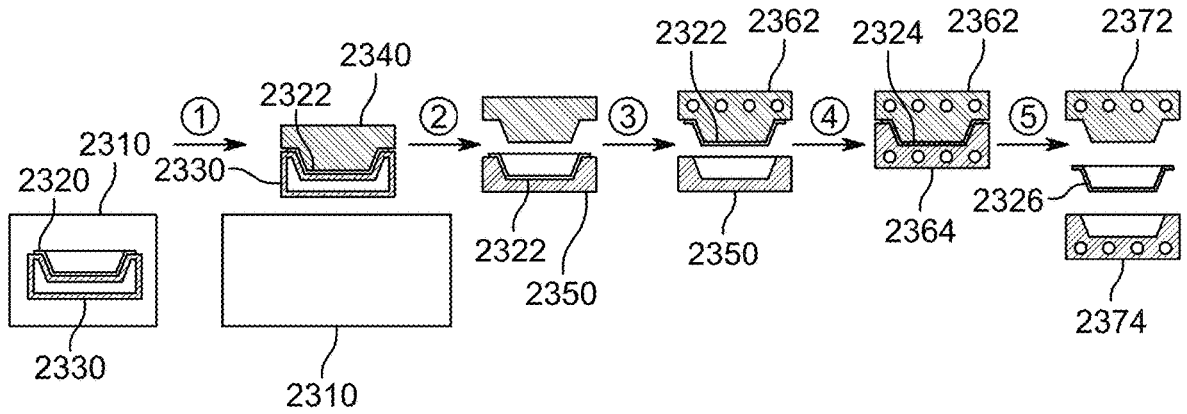
FIG. 23 shows an embodiment of a process for forming a cover having a detachable plug that is located at the peripheral edge of the cover and integrally formed with the cover.

FIG. 23 shows an embodiment of a process for forming a cover having a detachable plug that is located at the peripheral edge of the cover and integrally formed with the cover. In FIG. 23, the preparation process includes: S1: immersing the slurry forming die 2330 into the slurry in the slurry tank 2310. In one embodiment, the slurry is composed of decomposable or biodegradable plant fiber materials. Exemplary plant fiber materials include wood pulp, sugarcane pulp, reed pulp, bamboo pulp, palm pulp, etc. S2: the fiber of the slurry ("pulp fiber") 2320 is sucked onto the surface of the slurry forming die 2330 by vacuum suction. The forming die comprises a cover forming chamber and a detachable plug forming chamber located at the open peripheral edge of the cover forming chamber, and the cover forming chamber communicates with the detachable plug forming chamber.

S3: when the slurry forming mold 2330 is lifted (or taken out) from the slurry tank 2310, additional vacuum suction is applied to reduce the water content of the slurry fiber 2320, thereby forming a raw wet cup cover body 2322. S4: then, the slurry forming die 2330 can be pressed using the extrusion die 2340 (for example, using vacuum suction) to make the raw wet cup cover body 2322 have an initial shape, so as to form the formed wet cup cover body 2324. In one embodiment, the slurry forming die 2330 is pressed by the extrusion die 2340 to further reduce the water content of the formed wet cup cover body 2324. After pressing the slurry forming die 2330 using the extrusion die 2340, the formed wet cup cover 2324 is transferred to the hot pressing die composed of the upper heating die 2362 and the lower heating die 2364 by the transfer die 2350.

The hot pressing die is used to compress and dry the formed wet cup cover 2324 to form a semi-finished cup cover body 2326. When compressed and dried by the hot pressing die, the surface of the semi-finished cup cover body 2326 has enhanced smoothness (relative to the smoothness of the surface of the wet cup cover 2324 formed before compression and drying). Improved dimensional accuracy can also be achieved by compression and drying by the hot pressing die. In one embodiment, vacuum suction is applied during the drying process by the hot pressing die to remove any steam caused by the moisture retained by the formed wet cup cover body 2324 and reduce the possibility of delamination. S5: then, the semi-finished cup cover body 2326 is transferred to the cutting die composed of the upper cutting die 2372 and the lower cutting die 2374 to form the finished cup cover body. In one embodiment, the cutting die forms the finished cup cover body by trimming excess materials at the edge of the semi-finished cup cover body 2326.

Particular embodiments and their detailed construction and operation are described herein. The embodiments described herein are set forth by way of illustration only and not limitation. It should be recognized in light of the teachings herein that there is a range of equivalents to the example embodiments described herein. Most notably, other embodiments are possible, variations can be made to the embodiments described herein, and there may be equivalents to the components, parts, or steps that make up the described embodiments. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

One should also note that conditional language, such as, among others, "can," "could," "might," or "may," unless specifically stated otherwise, or otherwise understood within the context as used, is generally intended to convey that certain embodiment include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment. The terms "including", "comprising", "have", etc. are synonymous and used in an open manner, and do not exclude other elements, features, actions, operations, etc. In addition, the term "or" is used in an inclusive sense (rather than an exclusive sense), so when used to connect a series of elements, for example, the term "or" represents one element, some elements or all of the elements.

The terms and descriptions used herein are set forth by way of illustration only and are not meant as limitations. Those skilled in the art will recognize that those changes, enhancements and modifications and many other changes, enhancements and modifications can be made to the concepts described herein without departing from the basic principles of the present invention. Therefore, the scope of the present invention is defined only by the claims and their equivalents.

The invention claimed is:

1. A cover for use with a cup, comprising:

a cover body;

a dispensing port defined in the cover body and configured to provide an outlet for contents present in a cup when a first sealing structure is formed between the cover body and the cup;

a detachable plug integrally formed with, and affixed to, a peripheral edge of the cover body, which detachable plug is configured to be separated from the cover body at a tear line defined between the detachable plug and the peripheral edge of the cover body, the detachable plug including a protrusion that is configured to interact with the dispensing port to form a second sealing structure between the protrusion and the dispensing port; and a recess defined in the cover body that is configured to be detachably coupled with the protrusion of the detachable plug, so as to selectively retain the detachable plug on the cover body.

2. The cover of claim 1, wherein the tear line comprises:

tear connection points that connect each of opposing ends of a first edge of the detachable plug to the adjacent peripheral edge of the cover body; and a concave surface disposed between two successive tear connection points, which concave surface is recessed towards the detachable plug away from the cover body, wherein a distance from a middle of the concave surface to the peripheral edge of the cover body is greater than a distance from either end of the concave surface to the peripheral edge of the cover body.

3. The cover of claim 2, wherein the peripheral edge of the cover body is provided with an outer convex part, a side of the outer convex part away from the peripheral edge of the cover body is provided with an arc-shaped convex surface, and wherein a distance from the middle of the concave surface to a middle of the arc-shaped convex surface is greater than a distance from either end of the concave surface to a respective end of the arc-shaped convex surface.

4. The cover of claim 3, wherein the concave surface is any one of a V-shaped concave surface and a U-shaped concave surface.

5. The cover of claim 1, wherein the tear line includes three tear connection points arranged at intervals and connected between the end of the detachable plug close to the cover body and the peripheral edge of the cover body, wherein a strip-shaped tear hole is defined between each two adjacent tearing connection points, the peripheral edge of the cover body and the end of the detachable plug close to the cover body, and wherein a diameter of the each strip-shaped tear hole is gradually reduced from top to bottom.

6. The cover of claim 1, wherein the protrusion protrudes toward one surface of the detachable plug, and a concave groove corresponding to the protrusion is arranged on the other surface of the detachable plug away from the protrusion.

7. The cover of claim 1, wherein the cover body is made of plant fiber.

8. A cover, comprising:

a cover body;

a dispensing port defined in the cover body and configured to provide an opening through the cover body;

a recess defined in an upper surface of the cover body; and a detachable plug integrally formed with, and affixed to, a peripheral edge of the cover body, which detachable plug is configured to be fully separable from the cover body at a tear line defined between the detachable plug and the peripheral edge of the cover body, the detachable plug including a protrusion that is configured to be inserted into and have a friction fit with each of the dispensing port and the recess.

* * * * *